US008308453B2

(12) United States Patent
Yamamoto et al.

(10) Patent No.: US 8,308,453 B2
(45) Date of Patent: Nov. 13, 2012

(54) DIAPHRAGM PUMP

(75) Inventors: Mitsuru Yamamoto, Tokyo (JP); Kazuhito Murata, Tokyo (JP); Sakae Kitajo, Tokyo (JP)

(73) Assignee: NEC Corporation, Tokyo (JP)

( * ) Notice: Subject to any disclaimer, the term of this patent is extended or adjusted under 35 U.S.C. 154(b) by 591 days.

(21) Appl. No.: 12/448,694

(22) PCT Filed: Jan. 15, 2008

(86) PCT No.: PCT/JP2008/000022

§ 371 (c)(1),
(2), (4) Date: Jul. 1, 2009

(87) PCT Pub. No.: WO2008/090725

PCT Pub. Date: Jul. 31, 2008

(65) Prior Publication Data

US 2010/0074775 A1 Mar. 25, 2010

(30) Foreign Application Priority Data

Jan. 23, 2007 (JP) ..... 2007-012409

(51) Int. Cl.
*F04B 17/00* (2006.01)
*F04B 53/10* (2006.01)

(52) U.S. Cl. ..... 417/413.2; 417/560

(58) Field of Classification Search ..... 417/413.1, 417/413.2, 413.3, 560, 571
See application file for complete search history.

(56) References Cited

U.S. PATENT DOCUMENTS

| | | | | |
|---|---|---|---|---|
| 4,728,266 | A * | 3/1988 | Matsumoto et al. | 417/366 |
| 6,022,199 | A * | 2/2000 | Yoshii et al. | 417/269 |
| 7,635,257 | B2 * | 12/2009 | Inoue | 417/540 |
| 2009/0087323 | A1 * | 4/2009 | Blakey et al. | 417/413.2 |
| 2009/0148318 | A1 * | 6/2009 | Kamitani et al. | 417/413.2 |

FOREIGN PATENT DOCUMENTS

| | | | |
|---|---|---|---|
| JP | 51-75208 | | 6/1976 |
| JP | 61-116080 | | 6/1986 |
| JP | 61116080 | A * | 6/1986 |
| JP | 2001-173569 | | 6/2001 |
| JP | 2001-342963 | | 12/2001 |
| JP | 2003-35264 | | 2/2003 |
| JP | 2005-133704 | | 5/2005 |
| WO | WO 01/66947 | A1 | 9/2001 |

OTHER PUBLICATIONS

PCT/ISA/237 dated Apr. 2007, with partial English translation.

* cited by examiner

*Primary Examiner* — Charles Freay
(74) *Attorney, Agent, or Firm* — McGinn IP Law Group, PLLC

(57) ABSTRACT

A pump chamber (15) is formed between a piezoelectric vibrator (7) and a valve main plate (10). The valve main plate (10) includes an inlet port (13) at its central portion, and an outlet port (14) in its peripheral portion, and the inlet port (13) is made in a smaller diameter than the outlet port (14). On the valve main plate (10) an inflow check valve (11) and an outflow check valve (12) are provided, so that when the inflow check valve (11) and the outflow check valve (12) open and close in response to the vibration of the piezoelectric vibrator (7), a fluid is introduced into and discharged from the pump chamber (15).

19 Claims, 8 Drawing Sheets

(a)

(b)

(a)

(b)

(a)

(b)

(c)

(a)

(b)

DIAPHRAGM PUMP

TECHNICAL FIELD

The present invention relates to a diaphragm pump, for example a small and thin diaphragm pump for use in a water-cooling type cooling system that cools a heat generating body in an electric apparatus or an electronic component.

BACKGROUND ART

For example in electronic apparatuses such as personal computers, a conventional air-cooling type cooling system is no longer effective because of the progress in operating speed and expansion of functions, as well as because of the demand for reduction in dimensions of the apparatus, and a water-cooling type cooling system has now taken its place. The water-cooling type cooling system typically includes a diaphragm pump incorporated with a piezoelectric vibrator or the like that vibrates a wall of a pump chamber, to thereby intake and discharge a liquid fluid. FIG. 11 is a cross-sectional view of a popular diaphragm pump conventionally employed. As shown in FIG. 11, a casing 40 includes orifices communicating with a pump chamber 45, and an inflow check valve 41 and an outflow check valve 42 are installed so as to cover the respective orifice. At the respective end portions of the casing 40, an inlet port 43 and an outlet port 44 are provided. Above the casing 40, a piezoelectric vibrator 47 is located by means of a pump chamber tight seal 46, and an end portion of the piezoelectric vibrator 47 is press-fixed by a pump cover 48.

In the diaphragm pump thus constructed, when the piezoelectric vibrator 47 is activated by a current so as to vibrate up and downward alternately, the inflow check valve 41 and the outflow check valve 42 are caused to alternately open (alternately close), so that a cooling fluid introduced through the inlet port 43 flows through the pump chamber 45 and is discharged through the outlet port 44. While the fluid is being conveyed, a bubble contained in the fluid also moves into and out of the pump chamber. It is preferable to promptly drive out the bubble from the pump chamber, because the presence of the bubble affects the fluid conveying characteristic. Accordingly, various proposals have been made so far on the measures for smoothly discharging the bubble from the pump chamber.

For example, the patent document 1 teaches increasing the pressure in the pump chamber with a heater provided around the pump chamber, to thereby discharge the bubble. The patent document 2 proposes forming a groove between an intake valve and an exhaust valve of the pump chamber so as to increase the flow speed of the fluid and to thereby discharge the bubble, and locating the exhaust valve at a position higher than the intake valve, so as to let the bubble escape. Also, the patent document 3 proposes a structure that causes the fluid to be introduced into the pump chamber in a large curvature toward a peripheral portion thereof, thereby facilitating discharging the bubble.

The diaphragm pump is a volume-variable pump, and higher discharge pressure is one of the features thereof. Generally, a pump that provides higher discharge pressure can quickly discharge the bubble that has intruded into the pump chamber, through the outlet port. Even with the diaphragm pump which offers high discharge pressure, however, in case that the bubble intrudes into the pump chamber when the pump is connected to a passage that imposes high flow resistance (pressure loss), the bubble incurs the disadvantage of offsetting the discharge pressure of the pump and thereby decreasing the flow rate. The conventional diaphragm pump, typically exemplified by the piezoelectric pump, normally includes the inlet port at an end portion of the pump chamber and the outlet port at the other end portion, or both ports at the respective end portions. Besides the inlet port and the outlet port are of the same caliber. Therefore, the bubble that has once intruded into the pump chamber is detained along the peripheral portion of the pump chamber by the influence of the flow status within the chamber, and the influence of the viscosity and the surface tension of the fluid, and is difficult to be driven out. The diaphragm pumps according to the patent documents 1 to 3 have respectively undergone some improvements, but not yet to perfection.

An object of the present invention is to solve the problem incidental to the foregoing conventional art, and to provide a highly reliable diaphragm pump capable of quickly discharging a bubble that has intruded into the pump chamber, and thereby assuring the performance under a stable flow rate.

[Patent document 1] JP-A No. 2005-133704

[Patent document 2] JP-A No. 2003-035264

[Patent document 3] WO2001/066947

DISCLOSURE OF THE INVENTION

According to the present invention, there is provided a diaphragm pump comprising a pump chamber including a flexurally vibrating type diaphragm vibrator as a wall panel; an inlet port and an outlet port provided in the pump chamber; and a check valve provided at the inlet port and the outlet port respectively, to thereby convey a fluid by pumping action of intake and discharge caused by the vibration of the diaphragm vibrator; wherein the inlet port is located at a central portion of the pump chamber, and the outlet port is located in a plurality of numbers in the vicinity of a peripheral portion of the pump chamber.

Preferably, the inlet port and the outlet port are located on a wall panel of the pump chamber opposing the diaphragm vibrator. Preferably, a cross-section of the pump chamber taken parallel to the diaphragm vibrator is a circle or a regular polygon with rounded vertices. More preferable, the inlet port includes a plurality of orifices of a smaller diameter than that of the outlet port.

The bubble that has intruded into the pump chamber of a piezoelectric pump, a type of the diaphragm pump, is prone to reside in the vicinity of the peripheral portion of the pump chamber, because of the flow condition therein and the influence of the viscosity and surface tension of the fluid. Providing, therefore, the plurality of outlet ports close to the peripheral portion of the pump chamber, as the structure according to the present invention, facilitates the bubble to be discharged. Also, such structure provides a larger total area of the outlet ports than in the case where just a single outlet port is provided, which contributes to minimizing the pressure loss intrinsic to the pump, and thereby facilitating increasing the flow rate compared with a piezoelectric pump of the same size and shape.

Further, since the inlet port toward the pump chamber includes a plurality of orifices of a smaller diameter than that of the outlet port, the bubble can be broken into smaller ones upon intruding into the pump chamber, and the broken bubbles can be more easily discharged through the outlet port of the larger diameter.

In the diaphragm pump according to the present invention, the inlet port toward the pump chamber is located at a central portion thereof, and the plurality of outlet ports from the pump chamber is located close to the peripheral portion thereof. Such structure prevents stagnation in the flow of the fluid inside the pump chamber, thereby facilitating the bubble that has intruded into the pump chamber to be discharged. As a result, the pump can perform under a stable flow rate.

BEST MODE FOR CARRYING OUT THE INVENTION

Figure 1:
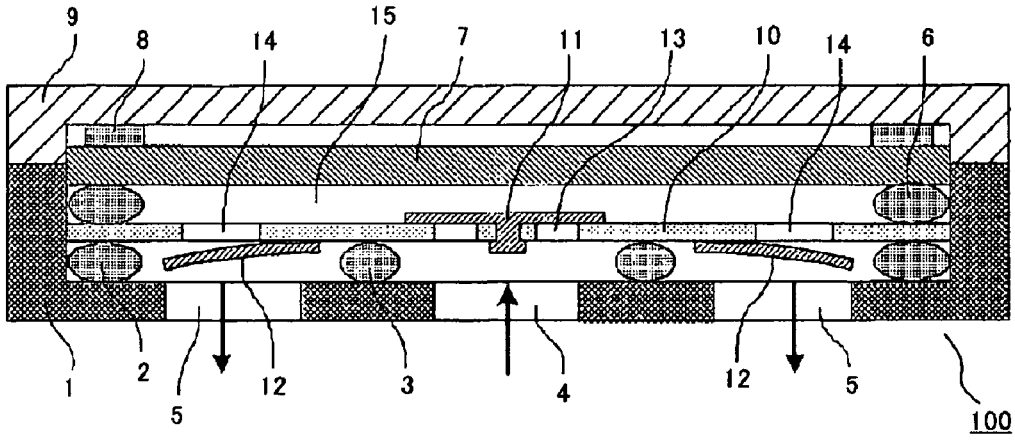
FIG. 1 is a cross-sectional view showing a diaphragm pump according to a first exemplary embodiment of the present invention.

Hereunder, exemplary embodiments of the present invention will be described in details referring to the drawings, based on a piezoelectric pump, which is a type of a diaphragm pump.

[First Exemplary Embodiment]

Figure 2:
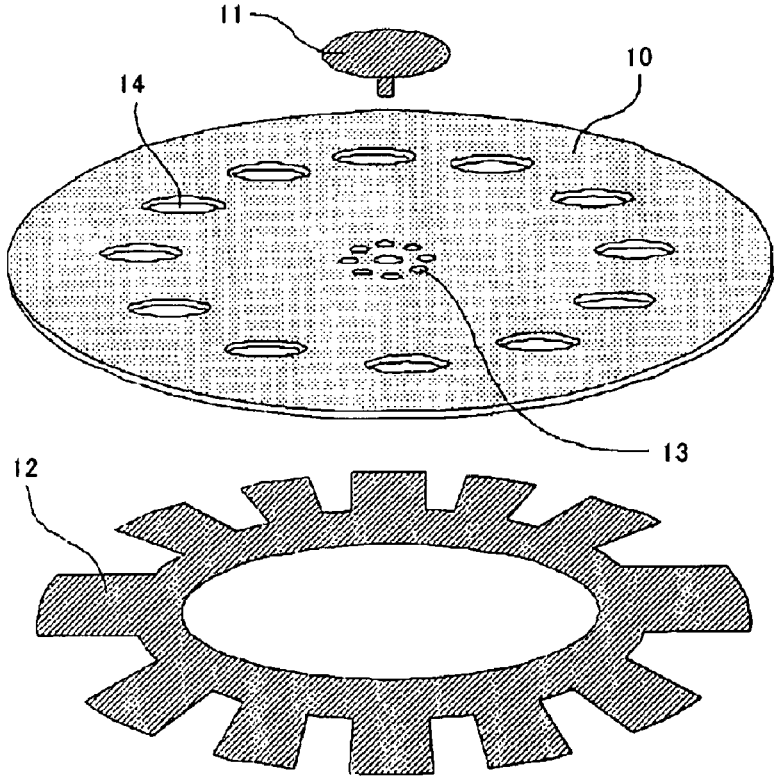
FIG. 2 is an exploded perspective view showing a valve main plate and a check valve according to the first exemplary embodiment of the present invention.

FIG. 1 is a cross-sectional view showing a piezoelectric pump according to a first exemplary embodiment of the present invention, and FIG. 2 is an exploded perspective view showing a valve main plate 10 and a check valve (inflow check valve 11 and outflow check valve 12), constituting an essential portion of the piezoelectric pump.

In FIGS. 1 and 2, the numeral 1 designates a pump casing, 2 a pump outlet port anti-leak partition seal, 3 a pump inlet port partition seal, 4 a pump inlet port, 5 a pump outlet port, 6 a pump chamber anti-leak partition seal, 7 a piezoelectric vibrator, 8 a vibrator dumper, 9 a pump cover, 10 the valve main plate, 11 the inflow check valve, 12 the outflow check valve, 13 an inlet port, 14 an outlet port, and 15 a pump chamber.

In the piezoelectric pump shown in FIG. 1, the piezoelectric vibrator 7 flexurally vibrates, once an electric field is applied thereto. At the moment the piezoelectric vibrator 7 deforms so as to protrude upward, the inflow check valve 11 opens so that the fluid flows through the pump inlet port 4 and into the pump chamber 15. At this moment the outflow check valve 12 is attracted toward the valve main plate 10 so as to close the outlet port 14, and hence the fluid is inhibited from flowing out of the pump chamber 15. Then at the moment that the piezoelectric vibrator 7 deforms so as to protrude downward, the outflow check valve 12 is press-opened so that the fluid flows out of the pump chamber 15, and is discharged through the pump outlet port 5. At this moment the inflow check valve 11 is closed. Repetitions of such actions constitute the intake-discharge cycles, thereby performing the function as a pump. It is to be noted that in the diaphragm pump according to the present invention, a plurality of inlet ports 13 is located at the central portion of the valve main plate 10 disposed so as to oppose the piezoelectric vibrator 7, and a plurality of outlet ports 14 is located along the peripheral portion of the valve main plate 10.

Figure 3:
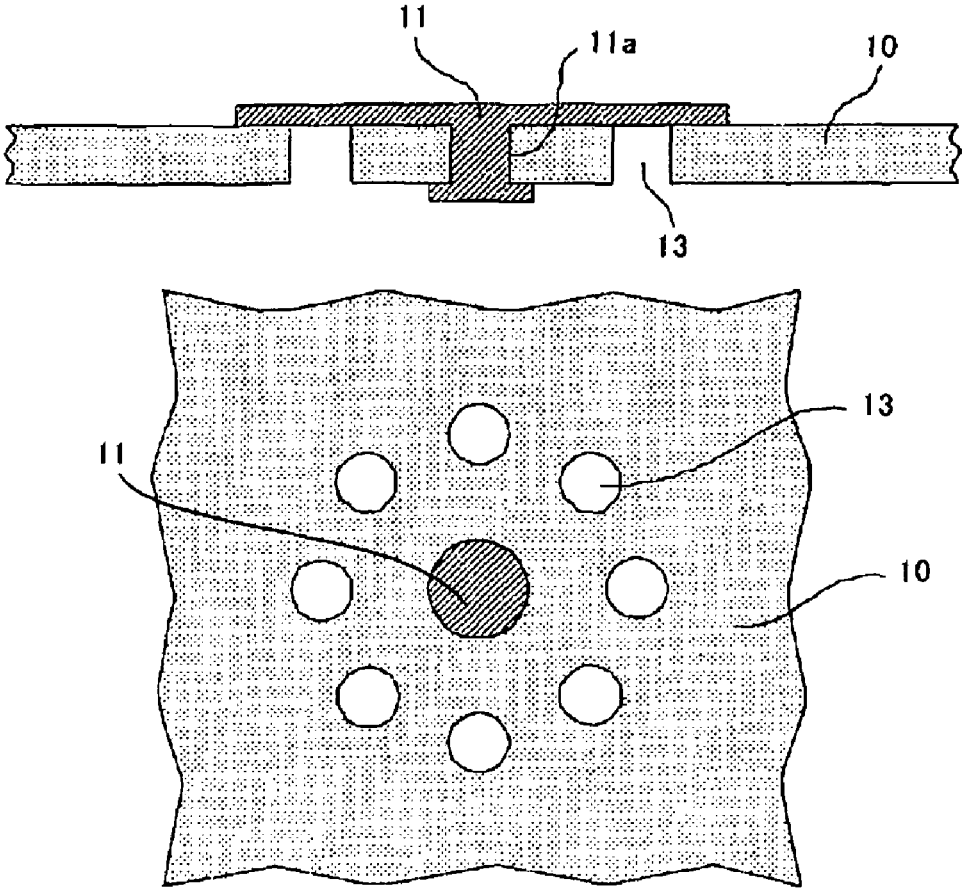
FIGS. 3(*a*) and 3(*b*) are drawings showing a closed state and an open state of an inflow check valve according to the first exemplary embodiment of the present invention.
Figure 3:
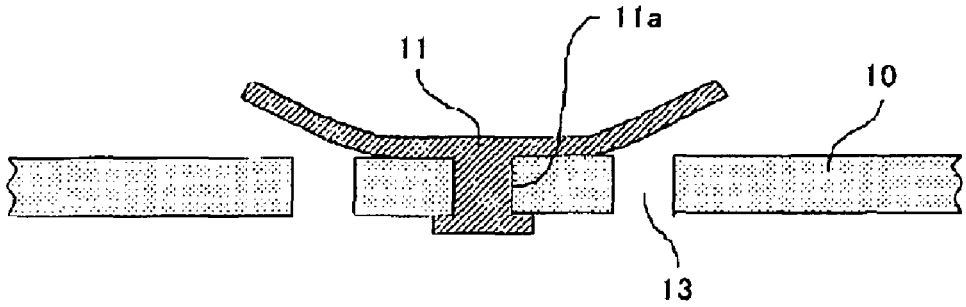
Figure 4:
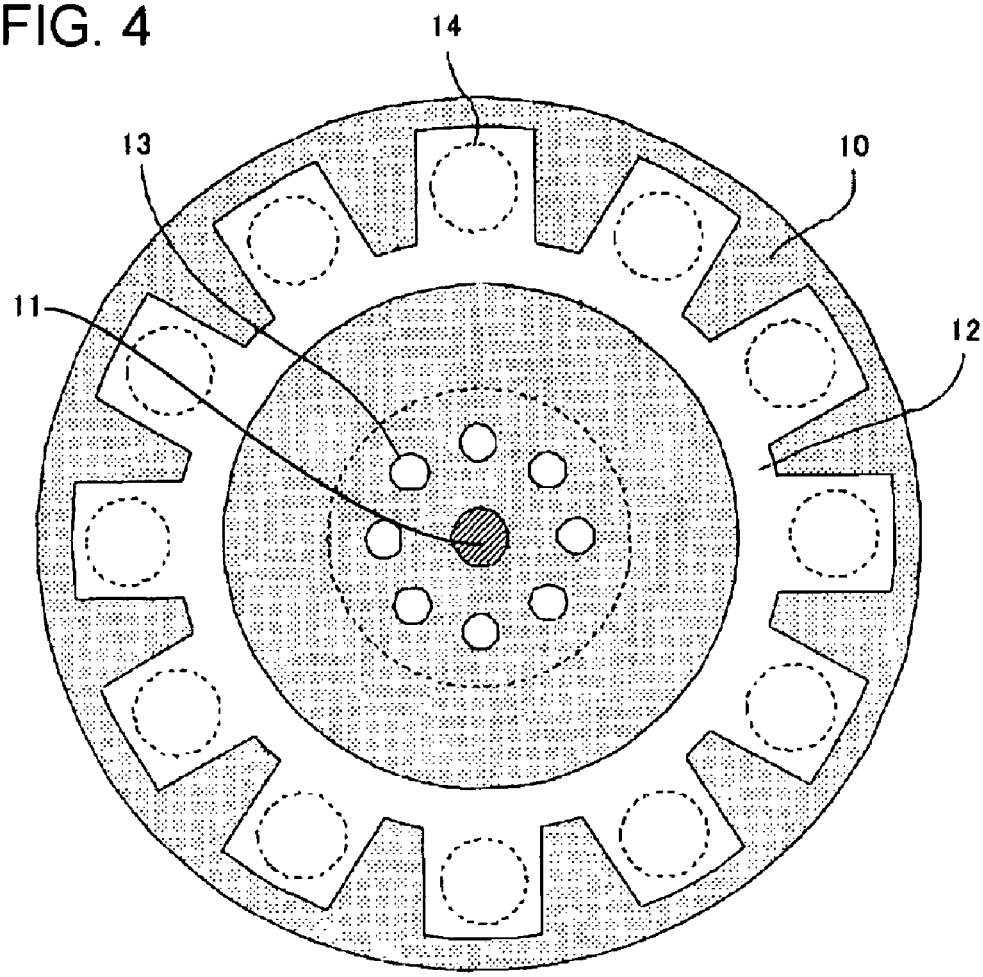
FIG. 4 is a plan view from the bottom, showing the valve main plate according to the first exemplary embodiment.

FIGS. 3(*a*) and 3(*b*) illustrate a portion of the valve main plate 10 around the inlet ports 13 in an enlarged scale. FIG. 3(*a*) includes a cross-sectional view (upper drawing) and a plan view from the bottom (lower drawing) of the vicinity of the inlet port 13 in a closed state, and FIG. 3(*b*) is a cross-sectional view in an open state. The inlet ports 13 are aligned along a circumference of the same circle located such that the center thereof coincides with that of the valve main plate 10, and the diameter of each inlet port is smaller than that of the outlet port 14. The inflow check valve 11 which opens and closes the inlet port 13 includes a valve fixing base 11*a*, which serves as the fulcrum for the portion around the valve fixing base 11*a* to be lifted as shown in FIG. 3(*b*), for thus opening the inlet port 13. To enable such action, the inflow check valve 11 may be constituted of a thin resin film (for example, a synthetic rubber or polyimide) of approx. 0.1 to 0.5 mm in thickness. Referring now to FIGS. 2 and 4, the structure of the check valve 12 provided for the outlet port 14 will be described. FIG. 4 is a bottom-side plan view of the valve main plate 10 with the check valve 14 attached thereto. As shown therein, the plurality of outlet ports 14 is aligned along the peripheral portion of the valve main plate 10, and the outflow check valve 12 is provided so as to cover the respective orifices. The outflow check valve 12 includes a valve portion that covers each orifice constituting the outlet port 14, and a circular portion connecting those valve portions in common. The inflow check valve 12 is attached to the valve main plate 10 by attaching the circular portion thereto by a welding technique such as spot welding. The outflow check valve 12 is integrally formed in a desired shape by an etching process on a thin metal plate such as a stainless steel foil of approx. 0.02 to 0.03 mm in thickness, so as to facilitate the attaching work by welding or the like. Such structure allows the fluid introduced into the pump chamber 15 to be discharged through the outlet port 14 without stagnation. The bubble about to intrude into the pump chamber 15 is broken into smaller ones by the inlet port 13 of a smaller diameter, upon entering the pump chamber 15. The bubbles that have thus intruded therein are quickly discharged out of the pump through the plurality of outlet ports 14 opened along the peripheral portion of the valve main plate 10. Consequently, the pumping action can be stabilized, and the flow rate can also be stably maintained. Besides, a larger total area of the outlet ports 14 can be secured compared with the outlet port of the conventional piezoelectric pump of the same or similar size, which leads to an increase in flow rate of the fluid up to approx. 1.5 to three times of that of the conventional diaphragm pump.

[Second Exemplary Embodiment]

Figure 5:
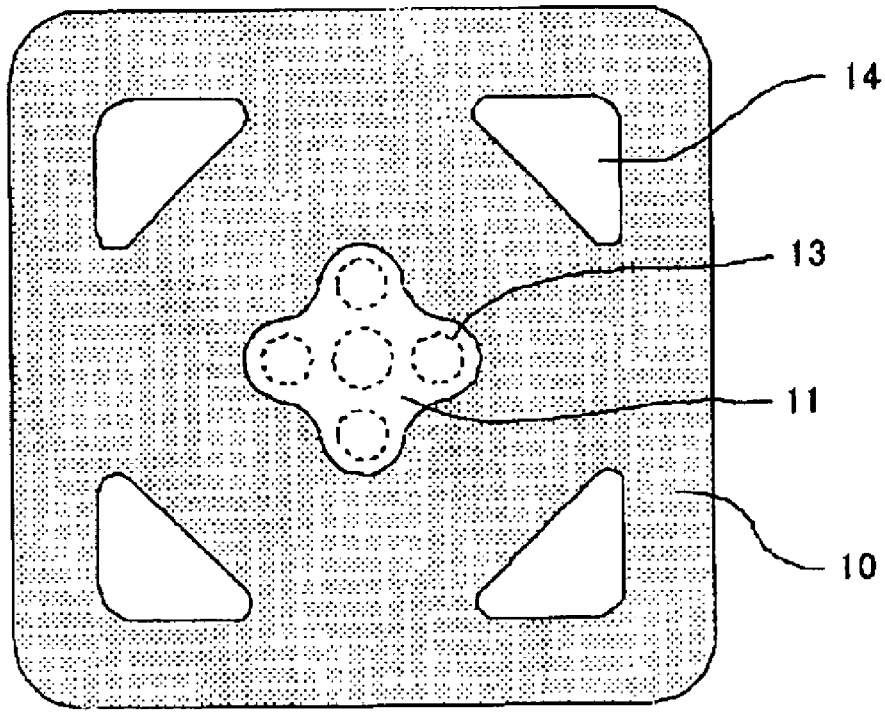
FIGS. 5(*a*) and 5(*b*) are plan views from the top and the bottom respectively, showing a valve main plate according to a second exemplary embodiment of the present invention.
Figure 5:
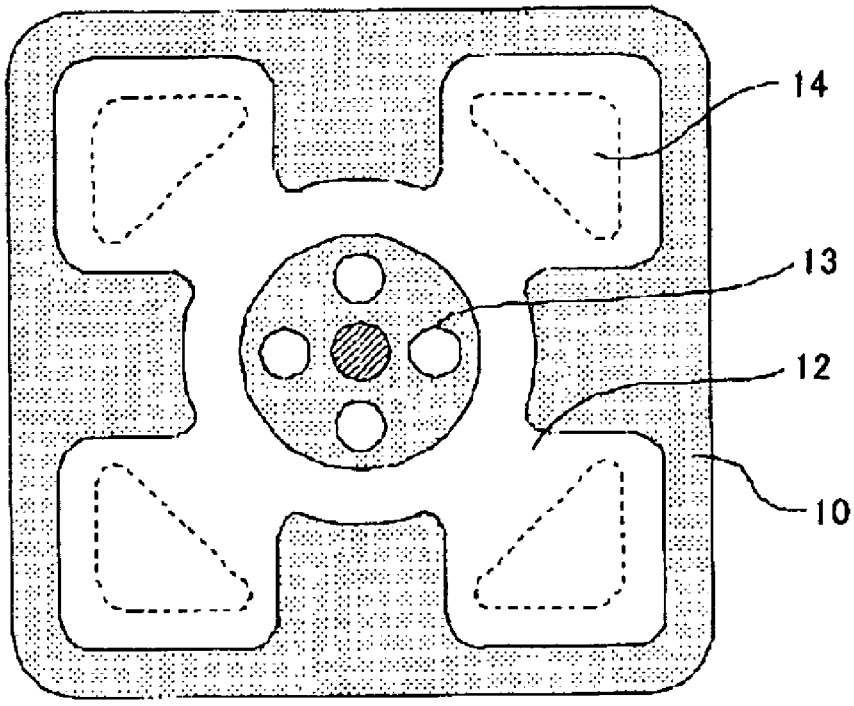

FIGS. 5(*a*) and 5(*b*) are plan views from the top and the bottom respectively, showing the valve main plate 10 according to a second exemplary embodiment of the present invention. In FIGS. 5(*a*) and 5(*b*), the same constituents as those of the foregoing embodiment shown in FIGS. 1 and 2 are given the same numerals, and the duplicating description will not be repeated. The pump chamber of the piezoelectric pump according to the foregoing embodiment has a circular transverse cross-section, and accordingly the valve main plate is also circular, however in this embodiment those are of a square shape with rounded corners. In this embodiment, the outlet ports 14 are of a shape similar to an isosceles triangle and located at the four corners of the valve main plate, while the configuration of the remaining portion is the same as that of the first exemplary embodiment, and the inflow check valve 11 which opens and closes the inlet port 13 is constituted of a resin film, and the outflow check valve 12 which opens and closes the outlet port 14, of a metal film.

This embodiment is effective in such a case that the location for installing the pump does not accept a circular pump. Although the plan-view shape of the valve main plate is generally square in the second exemplary embodiment, the shape is not limited thereto according to the present invention, but may be a different polygon such as regular hexagon. Also, the vertices of the polygon do not necessarily have to be rounded.

Third Exemplary Embodiment

Figure 6:
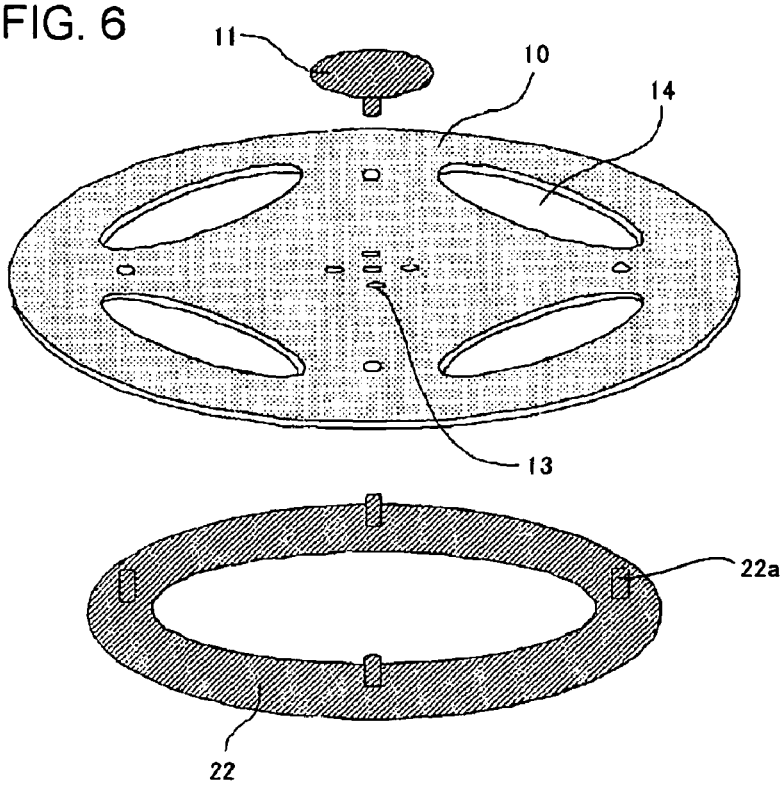
FIG. 6 is an exploded perspective view showing a valve main plate and a check valve according to a third exemplary embodiment of the present invention.
Figure 7:
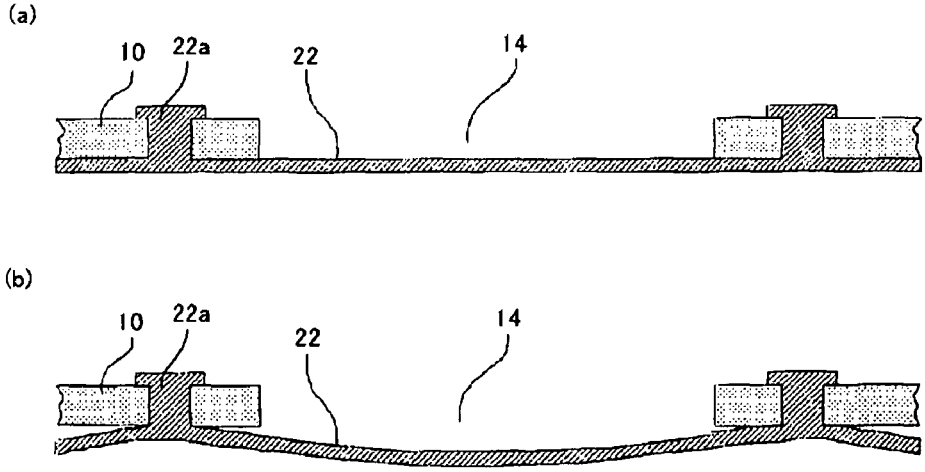
FIGS. 7(*a*) and 7(*b*) are cross-sectional views respectively showing a closed state and an open state of an outflow check valve according to the third exemplary embodiment of the present invention.

FIG. 6 is an exploded perspective view showing a valve main plate 10 and check valves 11, 22 according to a third exemplary embodiment of the present invention. As shown therein, the outlet port 14 is a generally elliptical slot, and provided in a plurality of numbers along the outer wall of the pump chamber. Such slot shape contributes to increasing the area of the outlet port, thereby facilitating discharging the bubble that has intruded into the pump chamber. The outflow check valve 22 for opening and closing the outlet port 14 of such slot shape may be constituted of a resin film which has a low elastic modulus and tightly sticks to the valve main plate (for example, fluoric resin, ethylene propylene rubber (EPDM), silicone rubber, polyimide resin and so on) of approx. 0.1 to 0.5 mm in thickness, and is formed in a generally circular ring shape. FIGS. 7(*a*) and (*b*) are cross-sectional views respectively showing a closed state and an open state of the outflow check valve 22. The outflow check valve 22 can be obtained through forming a resin film of a low elastic modulus into a ring shape, and attaching valve fixing bases of a projecting shape at four or more positions on the ring. The outflow check valve 22 moves up and down like a bridge about the valve fixing base 22*a* serving as the fulcrum (node), thus opening and closing the outlet port 14. Such structure prevents the bubbles from residing in the pump chamber and thereby constantly stabilizing the flow rate.

[Variation of the Third Exemplary Embodiment]

Figure 8:
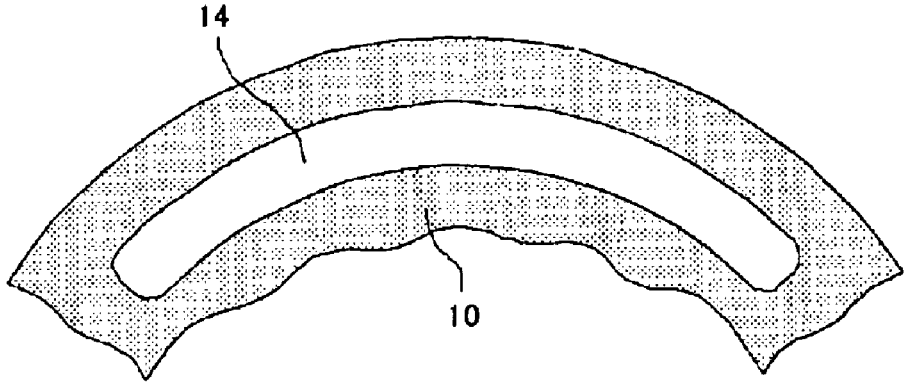
FIGS. 8(*a*) to 8(*c*) are fragmentary plan views respectively showing a variation of the valve main plate according to the third exemplary embodiment of the present invention.
Figure 8:
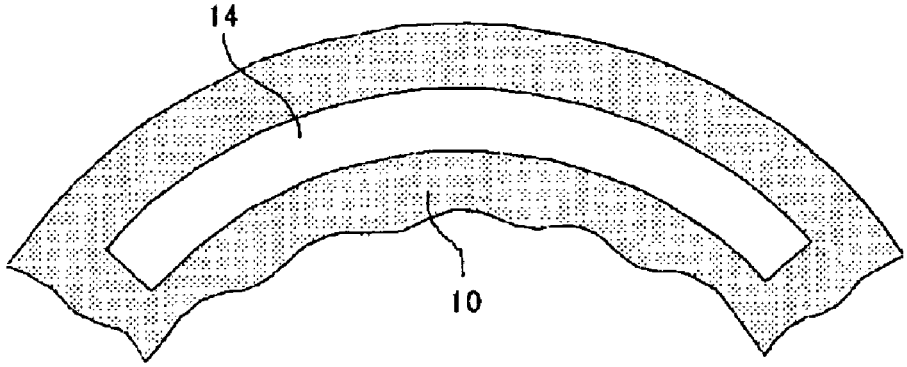
Figure 8:
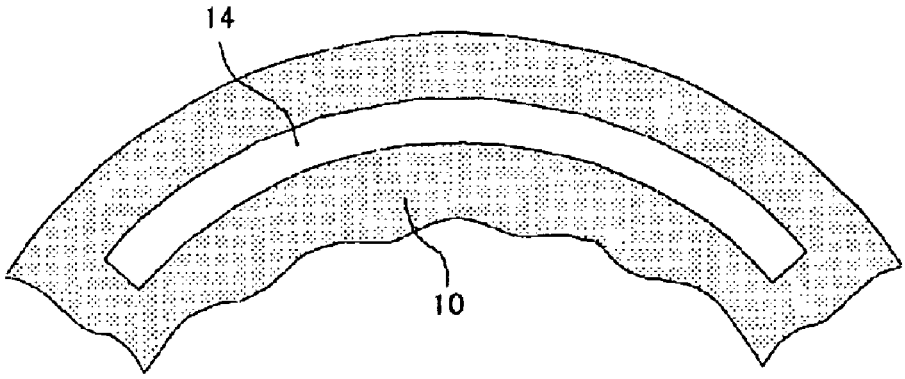
Figure 9:
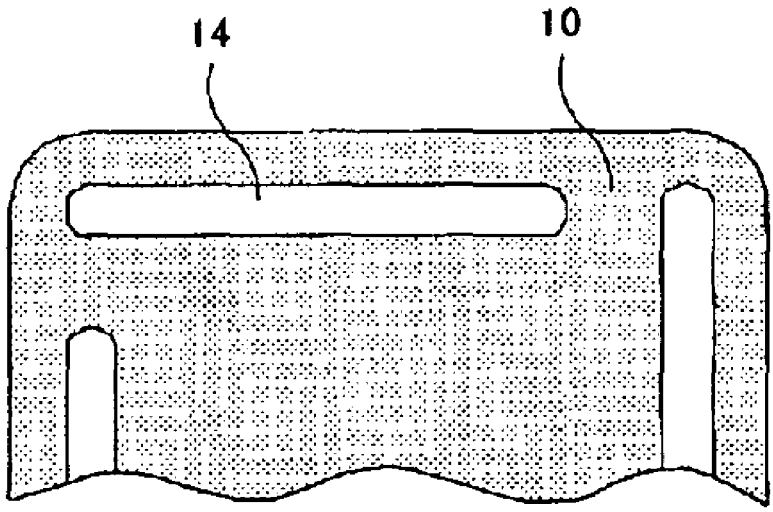
FIGS. 9(*a*) and 9(*b*) are fragmentary plan views respectively showing a variation of the valve main plate according to the third exemplary embodiment of the present invention.
Figure 9:
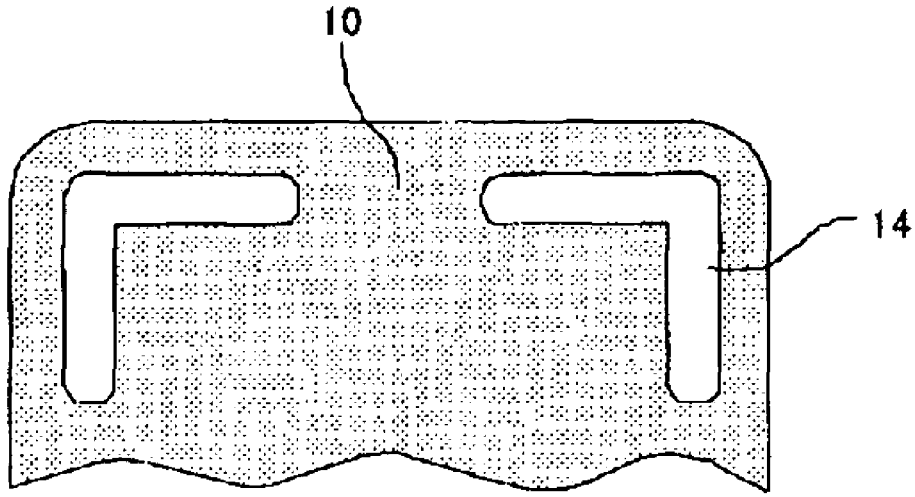

FIGS. 8(*a*), 8(*b*) and 8(*c*) are plan views respectively showing the valve main plate 10 according to the third exemplary embodiment. Although the outlet port 14 of the valve main plate 10 is formed in a elliptical slot according to the third exemplary embodiment, the shape of the outlet port 14 is not limited thereto, and the similar advantage can be attained provided that the slot is formed along the outer wall of the pump chamber in a shape that follows up the shape of the outer wall. Further, in the case where the valve main plate 10 is of a shape similar to a square, the outlet port 14 may be a linear or an L-shaped slot, as shown in FIGS. 9(*a*) and 9(*b*). For those valve main plates 10 as shown in FIGS. 8(*a*) to 8(*c*) and 9(*a*) and 9(*b*), the outflow check valve which covers the outlet port 14 is constituted of a resin film having a low elastic modulus and formed in a ring shape, as in the third exemplary embodiment.

[Fourth Exemplary Embodiment]

Figure 10:
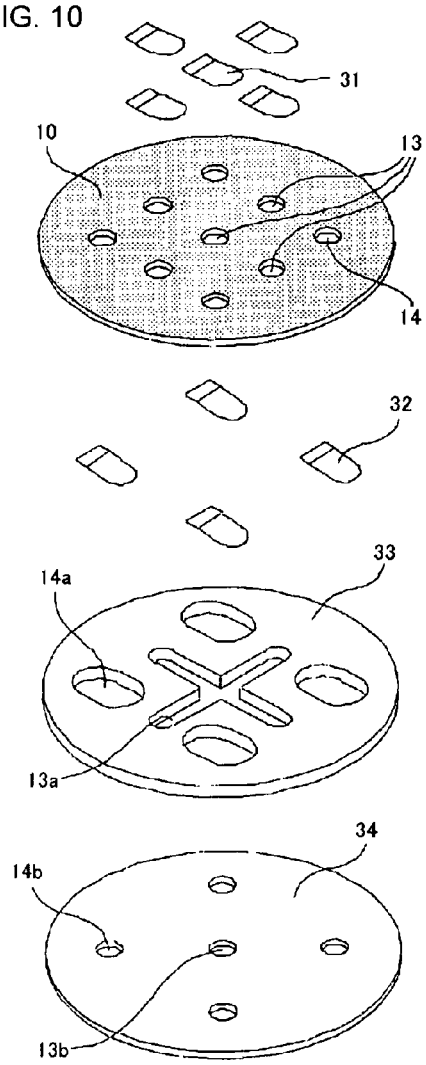
FIG. 10 is an exploded perspective view showing an essential portion of a fourth exemplary embodiment of the present invention.
Figure 11:
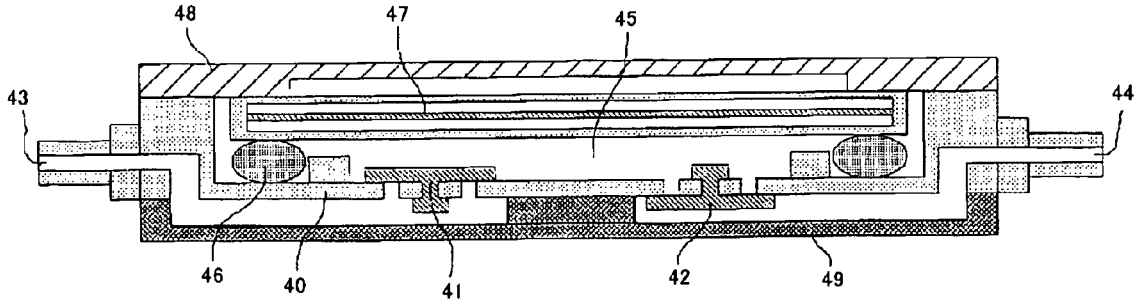
FIG. 11 is a cross-sectional view showing a conventional diaphragm pump.

FIG. 10 is an exploded perspective view showing an essential portion of check valves 31, 32 and the valve main plate 10 according to a fourth exemplary embodiment of the present invention. In FIG. 10, the numeral 10 designates the valve main plate, 31 the inflow check valve, 32 the outflow check valve, 33 an incoming fluid splitting plate, and 34 an inlet/outlet plate. The valve main plate 10 includes five inlet ports 13 in its central portion, and four outlet ports 14 in its peripheral portion. The incoming fluid splitting plate 33 includes a cross-shaped fluid splitting orifice 13*a* that splits the incoming fluid, and outlet ports 14*a* of such a size that prevents interference with the opening/closing motion of the outflow check valve 32. Further, the inlet/outlet port plate 34 includes an inlet port 13*b* in its central portion and four outlet ports 14*b* in its peripheral portion. The three plates 10, 33, 34 to be adhered to each other may be bonded with an adhesive, or pressed or swaged with a sealing material such as rubber interleaved therebetween. The fluid introduced through the inlet port 13*b* of the inlet/outlet port plate 34 is split by the fluid splitting orifice 13*a* of the incoming fluid splitting plate 33, and then flows into the pump chamber through the inlet ports 13 of the valve main plate 10. Splitting thus the incoming fluid before introducing the fluid into the pump chamber facilitates smoothly discharging the bubble, irrespective of the installing orientation of the pump, for example whether the pump is horizontally or vertically installed. In the case where the pump is actually installed in a vertical orientation, the bubble is kept from residing inside the pump chamber, and hence a stable flow rate can be constantly maintained. Also, introducing the incoming fluid into the pump chamber after splitting the fluid as above allows locating the plurality of inlet ports and outlet ports at shorter intervals, thereby preventing the stagnation of the flow in the pump chamber and thus facilitating the bubble to be discharged.

Although the piezoelectric vibrator is taken up as the diaphragm vibrator in the foregoing embodiments, a structure that converts a motion of, for example, a shape-memory alloy, a heat distortion device, or a vibrating body that electrically or mechanically rotates or reciprocates, into flexural vibration of a diaphragm vibrator by means of a hinge or the like, may be employed instead. In the case of employing the piezoelectric vibrator, the power consumption can be minimized because of the high conversion efficiency.

The invention claimed is:

1. A diaphragm pump, comprising:

a pump chamber including a flexurally vibrating type diaphragm vibrator as a wall panel;

a plurality of inlet ports and a plurality of outlet ports provided in said pump chamber;

a check valve provided at one of said plural of inlet ports and one of said plurality of outlet ports respectively, to thereby convey a fluid by pumping action of intake and discharge caused by vibration of said diaphragm vibrator;

a valve main plate including said plurality of inlet ports and said plurality of outlet ports;

an incoming fluid splitting plate including an incoming fluid splitting orifice that splits an incoming fluid toward said plurality of inlet ports, and a second outlet port communicating with said plurality of outlet ports; and an inlet/outlet port plate including a second inlet port communicating with said incoming fluid splitting orifice of said incoming fluid splitting plate, and a third outlet port communicating with said outlet port of said incoming fluid splitting plate;

wherein at least one of said plurality of inlet ports is located at a central portion of said pump chamber, and said plurality of outlet ports is located in a vicinity of a peripheral portion of said pump chamber, and wherein said valve main plate, said incoming fluid splitting plate and said inlet/outlet port plate are adhered to each other such that the valve main plate is located above the incoming fluid splitting plate and the incoming fluid spitting plate is located above the inlet/outlet port plate.

2. The diaphragm pump according to claim 1, wherein said plurality of inlet ports and said plurality of outlet ports are located on a wall panel of said pump chamber opposing said diaphragm vibrator.

3. The diaphragm pump according to claim 1, wherein a cross-section of said pump chamber taken parallel to said diaphragm vibrator is a circle or a regular polygon, or a shape similar thereto.

4. The diaphragm pump according to claim 1, wherein said inlet port and said outlet port are point-symmetrically located about a center of said wall panel of said pump chamber opposing said diaphragm vibrator.

5. The diaphragm pump according to claim 1, wherein said plurality of inlet ports includes a plurality of orifices of a smaller diameter than that of said plurality of outlet ports.

6. The diaphragm pump according to claim 1, wherein said check valve of said inlet port includes a central portion serving as a fulcrum about which a remaining portion of said check valve bends up and downward, and comprises a resin film.

7. The diaphragm pump according to claim 1, wherein said check valve of said outlet port includes a ring-shaped base portion and a plurality of check valve portions radially extending therefrom toward a plurality of said outlet ports, and comprises a plate-shape thin metal film.

8. The diaphragm pump according to claim 1, wherein said check valve of said outlet port is formed through an etching process over a plate-shape thin metal film.

9. The diaphragm pump according to claim 1, wherein said plurality of outlet ports comprises an elliptical slot, or a slot formed along an outer wall of said pump chamber in a shape that follows up said pump chamber.

10. The diaphragm pump according to claim 9, wherein said check valve of said outlet port comprises a resin film formed into a ring shape connecting said plurality of outlet ports.

11. The diaphragm pump according to claim 1, wherein said check valve is individually provided for each inlet port and each outlet port of said valve main plate.

12. The diaphragm pump according to claim 1, wherein said second outlet port of said incoming fluid splitting plate is of a shape that prevents interference with an opening and closing action of said check valve of said outlet port.

13. The diaphragm pump according to claim 1, wherein said check valve of said inlet port is located on said valve main plate, and said cheek valve of said outlet port is located on said incoming fluid splitting plate.

14. The diaphragm pump according to claim 1, wherein said check valve comprises a resin film.

15. The diaphragm pump according to claim 1, wherein said diaphragm vibrator is driven by a piezoelectric vibrator.

16. The diaphragm pump according to claim 2, wherein a cross-section of said pump chamber taken parallel to said diaphragm vibrator is a circle or a regular polygon, or a shape similar thereto.

17. The diaphragm pump according to claim 2, wherein said plurality of inlet ports and said plurality of outlet ports are point-symmetrically located about a center of said wall panel of said pump chamber opposing said diaphragm vibrator.

18. The diaphragm pump according to claim 3, wherein said plurality of inlet ports and said plurality of outlet ports are point-symmetrically located about a center of said wall panel of said pump chamber opposing said diaphragm vibrator.

19. The diaphragm pump according to claim 2, wherein said plurality of inlet ports comprises a plurality of orifices of a smaller diameter than that of said plurality of outlet ports.

* * * * *